US010132038B2

(12) United States Patent
Strengell et al.

(10) Patent No.: US 10,132,038 B2
(45) **Date of Patent: *Nov. 20, 2018**

(54) STABILIZED SIZING FORMULATION

(71) Applicant: Kemira Oyj, Helsinki (FI)

(72) Inventors: Reetta Strengell, Espoo (FI); Juha Lindfors, Espoo (FI); Sari Hyvärinen, Espoo (FI); Sauli Vuoti, Espoo (FI)

(73) Assignee: Kemira Oyj, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/116,664

(22) PCT Filed: Feb. 6, 2015

(86) PCT No.: PCT/FI2015/050076

§ 371 (c)(1),
(2) Date: Aug. 4, 2016

(87) PCT Pub. No.: WO2015/118228

PCT Pub. Date: Aug. 13, 2015

(65) Prior Publication Data

US 2016/0348317 A1 Dec. 1, 2016

(30) Foreign Application Priority Data

Feb. 6, 2014 (FI) ..... 20145118

(51) Int. Cl.

| | |
|---|---|
| ***D21H 17/24*** | (2006.01) |
| ***D21H 17/16*** | (2006.01) |
| ***D21H 17/17*** | (2006.01) |
| ***D21H 17/31*** | (2006.01) |
| ***D21H 21/16*** | (2006.01) |

(52) U.S. Cl.
CPC ..... *D21H 17/24* (2013.01); *D21H 17/16* (2013.01); *D21H 17/17* (2013.01); *D21H 17/31* (2013.01); *D21H 21/16* (2013.01)

(58) Field of Classification Search
CPC ..... D21H 17/16; D21H 17/17; D21H 17/31; D21H 17/24; D21H 21/16
USPC ..... 162/175
See application file for complete search history.

(56) References Cited

U.S. PATENT DOCUMENTS

| | | | |
|---|---|---|---|
| 4,606,773 A | 8/1986 | Novak | |
| 5,647,898 A | 7/1997 | Fuertes et al. | |
| 6,093,217 A | 7/2000 | Frolich et al. | |
| 6,123,738 A | 9/2000 | Childers | |
| 6,123,760 A | 9/2000 | Varnell | |
| 2003/0106659 A1 | 6/2003 | Malmstrom et al. | |
| 2003/0209336 A1 | 11/2003 | Cimecioglu | |
| 2007/0074641 A1 | 4/2007 | Dyllick-Brenzinger et al. | |
| 2009/0188054 A1 | 7/2009 | Dyllick-Brenzinger et al. | |
| 2010/0261807 A1 | 10/2010 | Laine et al. | |
| 2012/0135050 A1* | 5/2012 | Dill | A61K 31/122 424/400 |
| 2012/0164193 A1* | 6/2012 | Dill | A61K 9/284 424/400 |
| 2012/0244221 A1* | 9/2012 | Dill | A61K 9/284 424/484 |

FOREIGN PATENT DOCUMENTS

| | | |
|---|---|---|
| CN | 1726320 A | 1/2006 |
| CN | 1761789 A | 4/2006 |
| CN | 101228315 A | 7/2008 |
| JP | H02-127594 A | 5/1990 |
| JP | H03-059191 A | 3/1991 |
| JP | 2004-149573 A | 5/2004 |
| RU | 2263172 C2 | 10/2005 |
| RU | 2429323 C2 | 9/2011 |
| WO | 9951816 A1 | 10/1999 |
| WO | 99/55736 A | 11/1999 |
| WO | 2008145828 A1 | 12/2008 |
| WO | 2009010483 A2 | 1/2009 |
| WO | 2011073522 A1 | 6/2011 |

OTHER PUBLICATIONS

Finnish Patent and Registration Office Search report of FI Patent application No. 20145118 dated Aug. 29, 2014.
State Intellectual Property Office of People's Republic of China, Office Action issued in appin. No. 20158000748.7 dated Jul. 31, 2017.
Finnish Patent and Registration Office, Office Action dated Dec. 8, 2016 issued on FI20145118.
Rospatent, Office Action issued in RU2016129033/05 (045204), dated Feb. 16, 2018.
Japan Patent Office, Office Action issued on JP2016-549479, dated Apr. 10, 2018.

* cited by examiner

*Primary Examiner* — Mark Halpern
(74) *Attorney, Agent, or Firm* — Berggren LLP

(57) ABSTRACT

The present invention is related to sizing agent formulations, especially to stabilizing a sizing formulation by a modified non-food polysaccharide. The method for preparation of the modified non-food polysaccharide is further provided.

10 Claims, 2 Drawing Sheets

STABILIZED SIZING FORMULATION

PRIORITY

This application is a National Entry under 35 U.S.C. section 371 of International Application number PCT/FI2015/050076 filed on Feb. 6, 2015 and claiming priority of Finnish national application number FI20145118, filed on Feb. 6, 2014, the contents of both of which are incorporated herein by reference.

FIELD OF THE INVENTION

The present invention relates to papermaking, and especially to a stabilized sizing formulation to be used in the paper manufacture and to a method for sizing paper.

BACKGROUND

Sizing makes the native fiber network hydrophobic and thus prevents or reduces the penetration of water or other aqueous liquids into the paper. Sizing prevents the spreading and strike through of ink or printing colors. Papermaking fibers have a strong tendency to interact with water. This property is important for the development of strong interfiber hydrogen bonds, especially during drying, and is also the reason why paper loses its strength when rewetted. A high absorbency is important for certain paper grades such as toweling and tissue. Also corrugated medium paper must be able to absorb to a certain degree to convert properly in the corrugating process. On the other hand such properties are disadvantageous for many paper grades, e.g., liquid packaging, top layer of corrugated board, writing and printing papers, and most specialty papers. The water and liquid absorbency can be reduced by the addition of sizing agents to the paper stock and/or by their application to the paper surface.

Since the 1950s various forms of rosin size in the form of paste, dispersed, fortified formulations, alkyl ketene dimer (AKD) size, alkenyl succinic anhydride (ASA) size, and polymers mainly based on styrene acrylate and styrene maleinate sometimes called polymeric sizing agents (PSAs), have come onto the market. Today, beside starch for paper strength improvement and polymer binders for paper coating, sizing agents are the most important quality-improving additives in the paper manufacturing.

When applied in papermaking an emulsion or a dispersion of the sizing agent is prepared. Among other uses in papermaking, cationized starch is commonly used also as a stabilizing agent of the sizing agent emulsions or dispersions.

Pure starch is a white, tasteless and odorless powder that is insoluble in cold water or alcohol. It consists of two types of molecules: the linear and helical amylose:

(1)

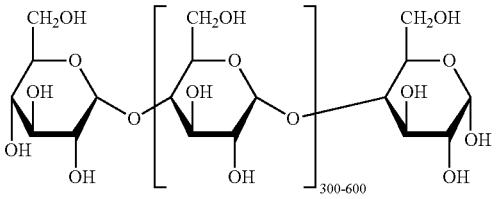

and the branched amylopectin:

(2)

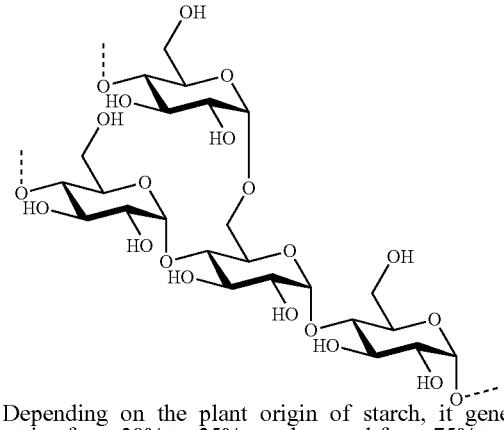

Depending on the plant origin of starch, it generally contains from 20% to 25% amylose and from 75% to 80% amylopectin by weight.

Galactomannans are polysaccharides consisting of a mannose backbone with galactose side groups. A segment of galactomannan showing mannose backbone with a branching galactose unit on the top is illustrated below.

(3)

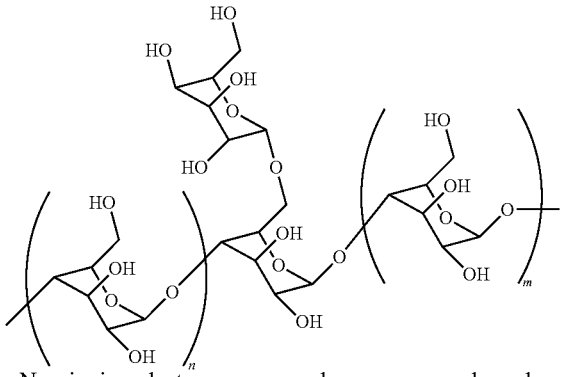

Non-ionic galactomannans such as guar gum have been used in emulsions of ASA sizing agent under controlled conditions. These ASA-guar gum emulsions were subjected to various treatments using a deposition rotor. Typically, the more guar gum is used in the emulsion, the more stable is the emulsion. The use of a further surfactant results in even less deposition, and a smaller average particle size of the emulsion.

In U.S. Pat. No. 4,606,773 an emulsion of alkenyl succinic anhydride (ASA) type of paper sizing agent is prepared using a cationic water-soluble polymer and a cationic starch as emulsifiers. In the disclosed method a water-soluble polymer is used as an emulsification aid. A cationically modified polymer having a molecular weight ranging between 20,000-750,000 is used in conjunction with water-soluble cationic starch, wherein the cationic starch to polymer weight ratio is between 75:25 to 25:75.

WO2008/145828 A1 discloses a xylan ester which may be present in a sizing composition. The esters are produced by reacting xylan with a short chained aliphatic carboxylic acid, such as formic, acetic, priopionic or butyric acid.

In the application of cationized starch for ASA stabilization typically a ratio from 1:1 to 4:1 of starch to ASA is used. Furthermore, starch used is also an important source of nutrition. Therefore, to develop more sustainable solutions for the future it would be highly advantageous to develop and use sizing agents comprising non-food based chemicals as emulsifiers in papermaking.

SUMMARY OF THE INVENTION

The object of the present invention is to provide a stable sizing agent formulation for use in paper and paper product manufacture.

A further object of the present invention is to provide a sizing agent formulation the components of which are of non-food origin thus rendering the sizing agent formulation more sustainable in use.

Yet, a further object of the present invention is to provide a more efficient stabilizing agent for use in sizing formulations.

The present invention provides modified derivatives of non-food, anti-nutritional polysaccharides. The modified non-food polysaccharides are successfully used as stabilizers in sizing formulations, and they are especially suitable for paper and paper product manufacture according to the present invention.

Typically starch has been used as stabilizer for the sizing agents. The present invention provides an attractive, more sustainable alternative for starch which alternative is of non-food origin. For technical purposes environmentally benign biopolymers should be used instead of nutritionally important starch.

One advantage in replacing starch with a non-food anti-nutritional polysaccharide is that more starch is rendered available for nutritional purposes.

Another advantage of the method and product of the present invention is that the concentration of the non-food polysaccharides required to provide the necessary stabilizing effect for the sizing formulation is remarkably lowered compared to other stabilizers thus providing an enhanced stabilization effect. Therefore, considerably less polysaccharides according to the present invention are needed compared, for example, to the amount of starch required. This may further lower the preparation cost of the sizing agent emulsions, and eventually also the cost for sizing agent formulation.

Yet, another advantage in providing the required stabilizing effect by using less stabilizing agent is that the amount of chemicals needed in subsequent processing may be decreased, as well. When starch is used as a stabilizer it is not fully retained in the paper. Unretained material will be contained in the eluents of the papermaking process. Therefore, the use of starch will increase the organic load of the wastewater in a papermaking process. When modified non-food polysaccharides according to the present invention, such as xylan or arabinogalactan, are used the amount of stabilizer needed is considerably lower lowering the organic load in the wastewaters, as well.

The present invention provides a method for preparation of modified non-food polysaccharides providing an enhanced stabilizing effect in sizing formulation.

The present invention further provides a stabilized sizing formulation and a method for preparation thereof. The use of the formulation is depicted, as well.

DETAILED DESCRIPTION OF THE PRESENT INVENTION

Figure 1:
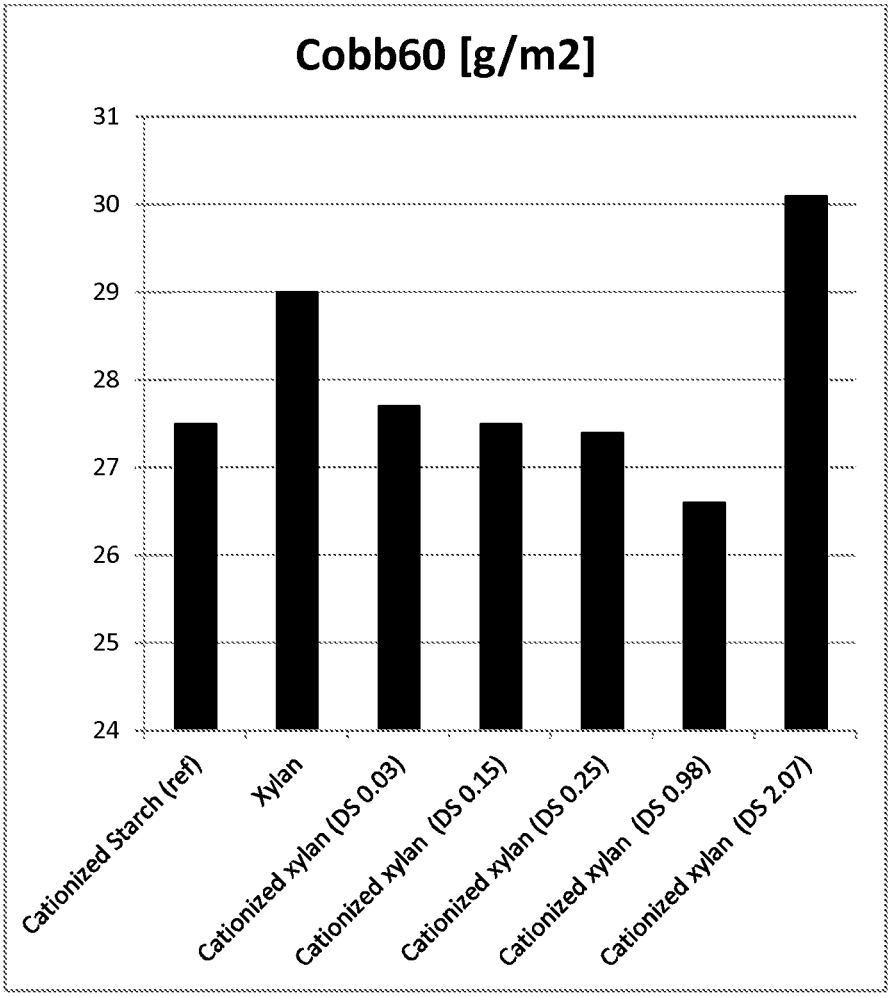
FIG. 1 shows the Cobb60 hydrophobicity results measured from paper sheets wherein GTAC cationized xylan is used for stabilizing an ASA sizing agent formulation.

By non-food polysaccharides is meant polysaccharides which fail to provide a source for a nutritional diet. Unlike starch, non-food polysaccharides cannot be used for nutritional purposes.

The non-food polysaccharides include indigestible non-starch polysaccharides (NSP) consisting of long chains of repeating glucose units. Unlike in starches, the glucose units in non-starch polysaccharides are joined by beta-acetal linkage bonds. The beta-acetal linkage cannot be split by the enzymes in the digestive tract. The non-starch polysaccharides include, for example, celluloses, hemicelluloses, gums, pectins, xylans, mannans, glucans and mucilages. Typical NSPs found in wheat are arabinoxylans and cellulose. In the present invention, preferably, the non-food polysaccharides are selected from xylan, arabinogalactan or mixtures thereof.

In one embodiment the stabilized sizing formulation of the present invention comprises a sizing agent and a modified non-food polysaccharide which comprises xylan or arabinogalactan or mixtures thereof.

Xylan (CAS number: 9014-63-5) is one example of highly complex polysaccharides that is found in plant cell wall and in certain algae. Xylan is a polysaccharide made from units of xylose which is a pentose sugar. Xylans are almost as ubiquitous as cellulose in plant cell walls and contain predominantly β-D-xylose units linked as in cellulose. The formula of a xylan may be presented as follows:

(4)

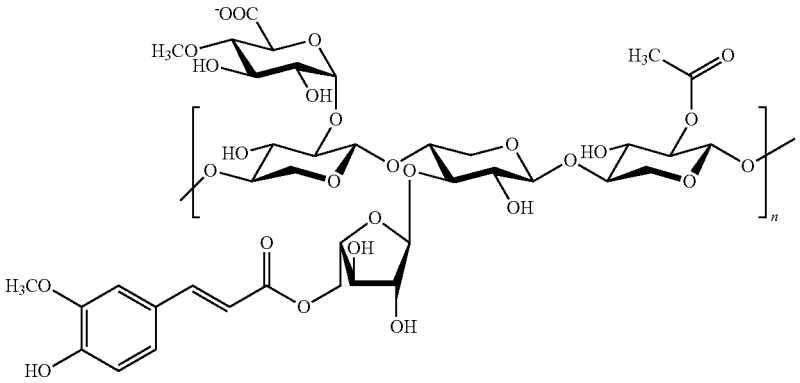

wherein n is the number of xylose units.

Another specific example of a non-food polysaccharide is arabinogalactan. It is a biopolymer consisting of arabinose and galactose monosaccharides. Two classes of arabinogalactans are found in nature: plant arabinogalactan and microbial arabinogalactan. In plants, it is a major component of many gums, including gum arabic and gum ghatti. Both the arabinose and galactose exist solely in the furanose configuration. An example of a structure of an arabinogalactan is presented by the following formula (5):

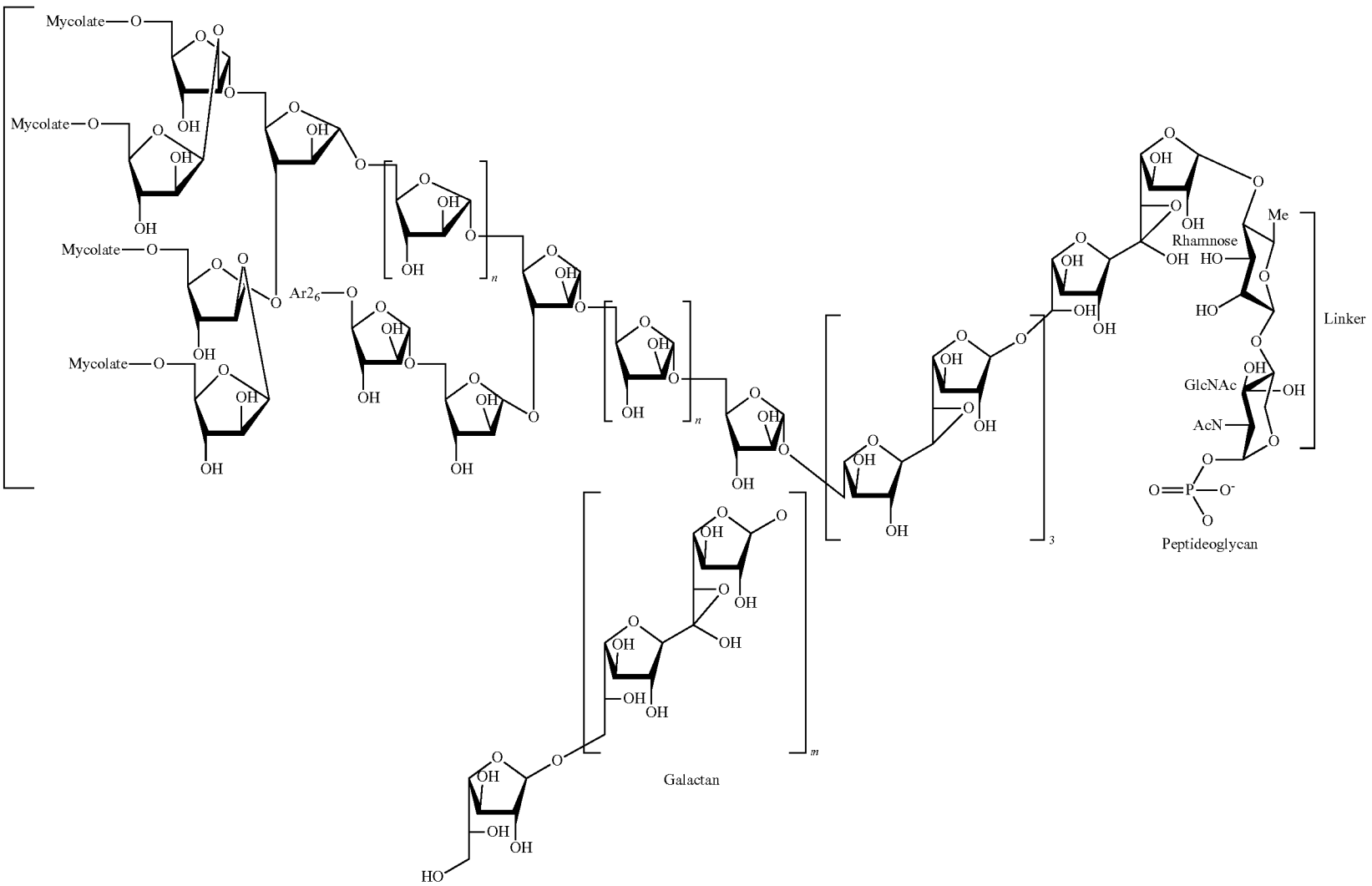
Linker
Me
Rhamnose
HO
HO
GlcNAc
AcN
Peptideoglycan
Galactan
Ar2$_6$
Mycolate
Mycolate
Mycolate
Mycolate An arabinogalactan from wood of the larch tree (*Larix laricina*) is composed of d-galactose and 1-arabinose in a 6:1 molar ratio accompanied by small amounts of d-glucuronic acid. Arabinogalactans are found in a variety of plants but are more abundant in *Larix occidentalis* (western larch).

In one aspect of the present invention a method for preparation of a modified non-food polysaccharide is provided. The properties of non-food polysaccharides may be modified by functionalizing or derivatizing with varying chemicals. The properties of the modified polysaccharides, such as hydrophobicity and/or plasticization, may be enhanced further by modifying them with esters and/or ether groups into the hemicellulose backbone. Depending on the quality of the substituents, the degree of substitutions, type of backbone, molecular weight of the remaining backbone, solubility and thermal properties can be changed remarkably and the dispersion properties enhanced even further.

The disclosed method comprises modifying the non-food polysaccharide by functionalization using a functionalizing agent which is capable of charging the non-food polysaccharide. The non-food polysaccharides may be modified to exhibit cationic or anionic properties. There are several methods available for carrying out this charging.

The non-food polysaccharide of the present invention is charged by rendering it cationic with a suitable cationization agent. This method for cationically charging the non-food polysaccharide comprises the steps of i. providing a mixture of charging reagent, water and a catalytic amount of base, and stirring said mixture thoroughly at a constant temperature above the room temperature, and ii. introducing the non-food polysaccharide and small amount of water to the mixture obtained from step i, and stirring the resulting mixture for several hours at a constant temperature, and subsequently iii. washing and filtering the resulting charged non-food polysaccharide before recovery.

In a preferred reaction method according to the present invention charged nonfood polysaccharides are prepared by reacting the non-food polysaccharide with a charged amino reagent. The charged amino reagent, water and a catalytic amount of base are mixed thoroughly and subjected to a constant temperature which is above room temperature. The non-food polysaccharide and a small amount of water, preferably less than 10% of the molar amount of the amino reagent, are introduced into this mixture. The mixture is stirred, preferably for at least 12 h, at the constant temperature. The resulting product is washed, preferably with alcohol and water, and filtered.

In one embodiment the non-food polysaccharide comprises xylan or arabinogalactan or mixtures thereof.

Preferably, the base is metal hydroxide, more preferably NaOH or KOH, most preferably NaOH. The catalytic amount of the base is preferably from 0.01 to 50%, more preferably from 0.01 to 10%, of the molar amount of non-food polysaccharide. The charged amino reagent is preferably a cationically charged amino reagent and more preferably selected from the group of 2,3-epoxypropyltrimethylammonium chloride (EPTA), 2-hydroxypropyltrimethylammonium chloride (HPMA), glycidyltriethylammonium chloride, glycidyltriethylammonium bromide or glycidyltriethylammonium methylsulfate, glycidyltripropylammonium chloride, glycidyltripropylammonium bromide, glycidyltripropylammonium methylsulfate and glycidyltrimethylammonium chloride (GTAC). Most preferably, the cationic amino reagent is glycidyltrimethylammonium chloride (GTAC). Preferably, the temperature is in steps i and ii from 35 to 50° C., more preferably from 40 to 50° C., such as about 45° C.

In one embodiment of the present invention the resulting cationic non-food polysaccharide derivative preferably contains quaternary ammonium groups with a high degree of substitution. These cationic non-food polysaccharide derivatives may be prepared by reaction of the polysaccharide, preferably with glycidyltrimethylammonium chloride (GTAC), in varying reaction media. In aqueous solutions of GTAC along with conventional hydrolysis of epoxy groups, their interaction with chloride ions also takes place. This results in formation of hydroxyl ions which accelerate both the hydrolysis of GTAC epoxy groups and can act as the internal catalyst in the reaction of GTAC with the polysaccharide. In this way cationic polysaccharides with a high degree of substitution may be obtained. The autocatalytic reaction of GTAC with the non-food polysaccharide proceeds more rapidly at higher temperatures, but with lower reaction efficiency. Both in the absence of the external catalyst and in the case when sodium alkali is used as a catalyst the reaction of polysaccharide with GTAC proceeds only when a particular quantity of free water is present in the system. When a base, preferably NaOH, is used as catalyst the reaction efficiency is about 90%. The yield of the non-food polysaccharide cationization reaction decreases when the quantity of free water is twice or thrice higher than required for the non-food polysaccharide modification to begin.

The preferred non-food polysaccharides to be cationized in the present invention are xylan or arabinogalactan or mixtures thereof.

The charging agents may be selected from commercially available reagents.

In one embodiment xylan is cationized using glycidyltrimethylammoniumchloride (GTAC) as charging agent. GTAC, water and a catalytic amount of NaOH are mixed thoroughly, and the mixture is pre-warmed at 45° C. Xylan and a small additional amount of water, preferably less than 10% of the molar amount of the amino reagent, are then added to the mixture, and the mixture is stirred thoroughly for about 16 hours at the constant temperature i.e. 45° C. The mixture is subsequently washed with alcohol, preferably ethanol, water and filtered.

The reaction mechanism is the following:

(7)

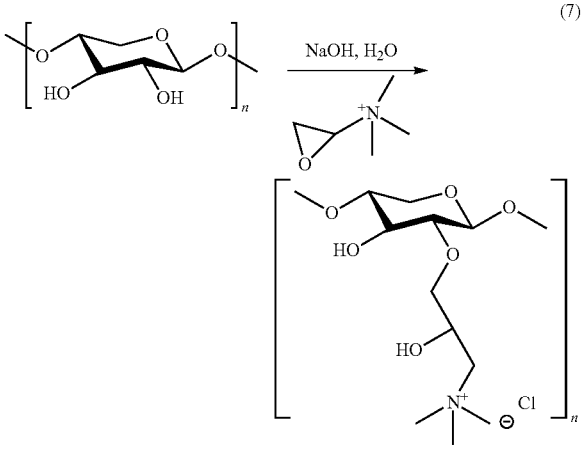

The degree of substitution (DS) for the cationized samples may be measured by analyzing the amount of nitrogen by the well-known Kjeldahl method and calculating the DS from the total amount of nitrogen in the samples using the following formula:

$$DS = \frac{132 \times N}{1400 - (151.5 \times N)} \quad (8)$$

where N is nitrogen amount estimated by Kjeldahl method (%), 132 is the molecular weight of repeating unit and 151.5 is the molecular weight of GTAC.

The degree of substitution (DS) is dependent on the reagents, reagent ratios and reaction conditions. The following table 1 depicts the influence of these parameters to DS in some of the tested cationic xylan samples which are made at 45° C. and wherein the reaction time has been 16 h.

TABLE 1

| D.S. | GTAC (mol) | H2O (mol) | NaOH (mol) |
|---|---|---|---|
| 0.03 | 0.5 | 5.0 | 0.076 |
| 0.15 | 1.0 | 5.0 | 0.076 |
| 0.25 | 0.5 | 2.5 | 0.038 |
| 0.98 | 3.0 | 15.0 | 0.300 |

In another embodiment arabinogalactan is cationized using glycidyltrimethylammoniumchloride (GTAC) as the cationic charging agent. GTAC, water and a catalytic amount of NaOH of the amount of GTAC used, are mixed thoroughly, and the mixture is prewarmed at 45° C. Arabinogalactan and a small additional amount of water, preferably less than 20 mol-%, more preferably less than 10 mol-%, are then added to the mixture, and the mixture is stirred thoroughly for about 16 hours at the constant temperature i.e. 45° C. The mixture is then washed with alcohol, preferably ethanol, water and filtered.

The following table 2 depicts the influence of the reagents and reagent ratios to DS in some of the tested cationic arabinogalactan samples.

TABLE 2

| D.S. | GTAC (mol) | H2O (mol) | NaOH (mol) |
|---|---|---|---|
| 0.1 | 1.0 | 0.1 | 0.076 |
| 0.25 | 0.5 | 5.0 | 0.076 |
| 0.34 | 0.75 | 5.0 | 0.076 |
| 0.5 | 1.25 | 5.0 | 0.076 |
| 0.75 | 1.0 | 5.0 | 0.076 |
| 0.94 | 2.0 | 10.0 | 0.150 |

The small additional amount of the water is preferably less than 20%, preferably from 5 to 20%, more preferably from 6 to 15% or even 6 to 10%.

The degree of substitution of the modified non-food polysaccharide is preferably from 0.03 to 1.5. The degree of substitution in the GTAC charged xylan is preferably from 0.1 to 1.5, more preferably from 0.1 to 1.1 whereas for GTAC charged arabinogalactan it is preferably from 0.75 to 1.5, more preferably from 0.8 to 1.2.

In another aspect of the present invention a stabilized sizing formulation is provided, comprising a sizing agent, and a cationically charged non-food polysaccharide.

The sizing agent of the formulation is preferably alkyl ketene dimer (AKD), alkenyl succinic anhydride (ASA) or mixtures thereof. The amount of ASA in the formulation is from 1 to 3% by weight, preferably from 1 to 2% by weight, most preferably from 1.2 to 1.3% by weight, such as from 1.24 to 1.26% by weight, of the formulation.

In one embodiment the stabilized sizing formulation comprises ASA or AKD, and a cationized xylan. The polysaccharide is most advantageously cationized using GTAC, and preferably the degree of substitution is less than 1.1, more preferably from 0.03 to 0.98.

In another preferred embodiment the stabilized sizing formulation comprises ASA or AKD, and a cationized arabinogalactan. The polysaccharide is most advantageously cationized using GTAC, and preferably the degree of substitution is from 0.75 to 1.1, more preferably from 0.9 to 1.0.

The amount of charged functionalized non-food polysaccharide to the sizing agent in the stabilized sizing formulation is from 0.05:1 to 1:1, preferably from 0.07:1 to 0.5:1, more preferably from 0.09:1 to 0.11:1. These amounts are considerably less than the corresponding amounts of starch required and tested as reference. The amount of starch required to provide the same stabilizing effect was about 20 times more.

The stabilized sizing formulation according to the present invention is preferably in a form of a dispersion, more preferably an emulsion.

In one embodiment the amount of ASA in the sizing emulsion formulation is 1.25% by weight and the amount of xylen cationically modified with GTAC to ASA is about 0.1:1.

In another embodiment the amount of ASA in the sizing emulsion formulation is 1.25% and the amount of arabinogalactan cationically modified with GTAC to ASA is 0.1:1.

The formulation according to the present invention may further contain typically used, or readily commercially available, emulsifiers, retention aids, such as e.g. Fennopol K3400 R, or promoters, such as PAC. The charging of the noon-food polysaccharide has a clearly enhanced effect on retention.

The dosage of the sizing agent formulation according to the present invention to the pulp is preferably from 0.5 to 3 kg/t when the formulation comprises the charged non-food polysaccharide stabilizing agent. It was found that the required amount of arabinogalactan based sizing formulation was slightly more, preferably about 30% more, than when using xylan based formulation.

In a further aspect of the present invention a method for preparing the stabilized sizing formulation is provided. The sizing agent and the charged non-food polysaccharide are brought into contact within an aqueous solution whereby a dispersion is formed.

In one embodiment the cationic noon-food polysaccharide is first dissolved into water or an aqueous solvent whereto the sizing agent is subsequently introduced. The mixture is then homogenized. The sizing agent is preferably mixed with an aqueous solution of the charged non-food polysaccharide to ensure efficient mixing.

Preferably, the sizing formulation is formed by homogenizing the aqueous mixture. The homogenization may be carried out in high pressure, preferably at a pressure from 140 to 160 bar.

In a yet further aspect of the present invention use of the stabilized sizing formulation as depicted above is provided for sizing paper and paper products. A preferred dosage amount of the sizing formulation into pulp furnish is from 0.5 to 3 kg/t.

The stability of the sizing formulation may be evaluated by preparing hand sheets and measuring the Cobb value of the paper product resulting from a manufacturing process utilising the sizing formulation. The Cobb60 value determines the water absorptiveness of sized paper according to ISO 535:1991(E) standard.

Using the stabilized sizing formulation according to the present invention Cobb60 values equal to the values obtained when using starch as stabilizer are obtained. In certain formulations the Cobb60 value is even lower than that measured from a starch based formulation. Thus, it is possible to replace starch stabilized sizing formulations with formulations comprising non-food polysaccharides without sacrificing the stabilizing ability or the quality of the final paper product.

It is further noted that the amount of charged modified non-food polysaccharide may be clearly less, possibly 1/10 or even 1/20, than the amount of starch needed, to reach equal results. The amount of the stabilizing agent in the emulsions of sizing formulations could be significantly lower, such as 1/20 of that compared to starch as a stabilizer. This has a particular effect on the effluent water chemical load and to the post processing and recycling of the effluent.

It is also possible to manufacture modified non-food polysaccharides having both cationic and anionic functionalities. The experimental results in terms of Cobb60 values, however, revealed that the performance of such formulations is inferior to merely cationically modified non-food polysaccharides.

Hereafter, the present invention is described in more detail and specifically with reference to the examples, which are not intended to limit the present invention.

EXAMPLES

Example 1

Five samples with varying degree of substitution are prepared from the commercially available non-food polysaccharide, xylan.

GTAC (Raisacat, Ciba-Basf), H20 and a catalytic amount of NaOH are mixed thoroughly in a reaction flask, and the flask was then instantly added to a prewarmed water bath at 45° C. Xylan and a small additional amount of water are then added to the mixture, and the mixture is stirred thoroughly for 16 hours at constant temperature. The mixture is then washed with ethanol, water and filtered.

The mixture is finally ultrafiltrated/dialyzed using a membrane cutoff of 1000-3000. For specific amounts of reagents, see Table 3 for details.

Sample for NMR analysis is dried in vacuum.

TABLE 3

| Sample Code | DS (Kjehldal) | GTAC (mol) | H2O (mol) | NaOH (mol) | Nitrogen content (mg/kg) | DS (NMR) |
|---|---|---|---|---|---|---|
| 1411 | 0.03 | 0.5 | 5.0 | 0.076 | 2700 | |
| 1210 | 0.15 | 1.0 | 5.0 | 0.076 | 12000 | |
| 1310 | 0.25 | 0.5 | 2.5 | 0.038 | 18000 | 0.2 |
| 1611 | 0.98 | 3.0 | 15.0 | 0.300 | 49000 | |
| 1511 | 2.07 | 1.5 | 7.5 | 0.150 | 65000 | |

| Sample Code | Xylan weight (g) | Yield (g) | Ultrafiltration/dialysis Cut off |
|---|---|---|---|
| 1411 | 100 | 75 | 3000 |
| 1210 | 100 | 55 | 3000 |
| 1310 | 60 | 41 | 3000 |
| 1611 | 100 | 55 | 3000 |
| 1511 | 100 | 72 | 3000 |

Example 2

Seven samples with varying degree of substitution are prepared from the commercially available non-food polysaccharide, arabinogalactan.

GTAC (Raisacat, Ciba-Basf), H20 and a catalytic amount of NaOH are mixed thoroughly in a reaction flask, and the flask was then instantly added to a prewarmed water bath at 45° C. Arabinogalactan and a small additional amount of water are then added to the mixture, and the mixture is stirred thoroughly for 16 hours at constant temperature. The mixture is then washed with ethanol, water and filtered.

The mixture is finally ultrafiltrated/dialyzed using a membrane cutoff of 1000-3000. For specific amounts of reagents, see Table 4 for details.

TABLE 4

| Sample Code | DS | GTAC (mol) | H2O (mol) | NaOH (mol) | Nitrogen content (mg/kg |
|---|---|---|---|---|---|
| 210 | 0.1 | 1.0 | 0.1 | 0.076 | 7200 |
| 711 | 0.25 | 0.5 | 5.0 | 0.076 | 21000 |
| 611 | 0.34 | 0.75 | 5.0 | 0.076 | 26000 |
| 511 | 0.5 | 1.25 | 5.0 | 0.076 | 34000 |
| 110 | 0.75 | 1.0 | 5.0 | 0.076 | 38000 |
| 310 | 0.94 | 2.0 | 10.0 | 0.150 | 48000 |
| 411 | 1.20 | 2.0 | 10.0 | 0.150 | 50000 |

| Sample Code | Arabinogalactan weight (g) | Yield (g) |
|---|---|---|
| 210 | 50 | 39.2 |
| 711 | 50 | 43.4 |
| 611 | 50 | 44.5 |
| 511 | 50 | 57.2 |
| 110 | 50 | 58.3 |
| 310 | 50 | 55.3 |
| 411 | 50 | 53.4 |

Example 3

ASA emulsions are prepared using a kitchen blender with 2 min mixing, after which they are passed through a homogenizer at 150 bar pressure.

Firstly, sizing emulsion is prepared from 1.25% ASA emulsions using GTAC cationized xylan from table 1 to ASA ratio of 0.1:1 as stabilizer.

Secondly, sizing emulsion is prepared from 1.25% ASA emulsions using GTAC cationized arabinogalactan from table 2 to ASA ratio of 0.1:1 as stabilizer.

As a reference sizing emulsion is prepared also from starch (Raisamyl 50021) and 1.25% ASA emulsion using starch to ASA ratio of 2:1 as stabilizer. Further reference samples are made from 1.25% ASA emulsions using xylan and arabinogalactan without cationization in ratios of 0.1:1 as stabilizers.

Example 4

Laboratory hand sheets, 80 g/m2, are prepared by introducing into 50/50 hardwood/softwood Kraft pulp furnish having a pH 8.5 the stabilized sizing formulations of example 3. No fillers are used in the resulting paper processing and the wet End starch amount is 5 kg/t.

The stabilized size formulation dosages used are 0.5 kg/t, 0.75 kg/t and 1.25 kg/t for the arabinogalactan stabilized sizes and 0.75 kg/t, 1.5 kg/t and 3 kg/t for the xylan stabilized sizes. K 3400R (200 g/t) is used a retention aid.

Figure 2:
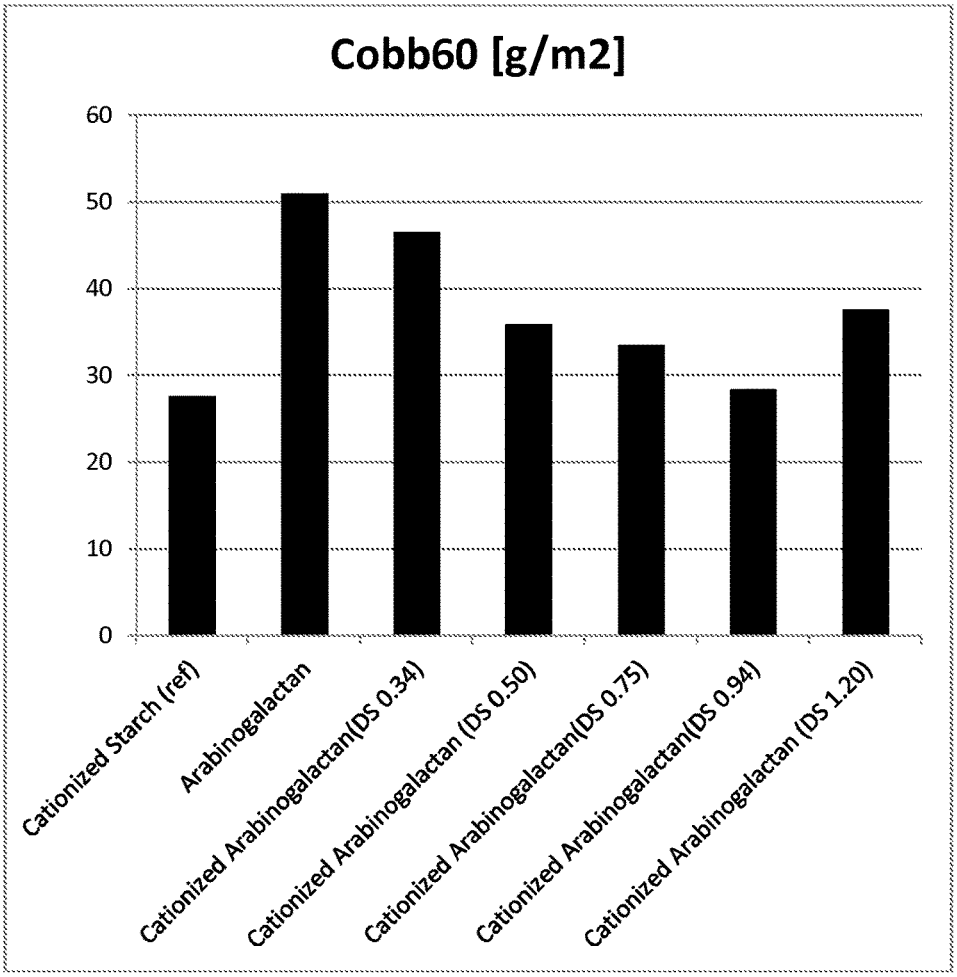
FIG. 2 shows the Cobb60 hydrophobicity results measured from paper sheets wherein GTAC cationized arabinogalactan is used for stabilizing an ASA sizing agent formulation.

The results from Cobb60 testing are depicted in FIG. 1 for xylan stabilized sizing agent formulation further depicting the reference sample result for starch, and in FIG. 2 for arabinogalactan stabilized sizing agent formulation.

The smaller the Cobb60 number the better the sizing, i.e. the paper product is more hydrophobic and absorbs less water.

FIG. 1 shows that the paper sheets wherein cationized xylan is used are at least as hydrophobic as when sizing with starch based sizing agent. The hydrophobicity is slightly increased when the degree of substitution is enhanced from 0.03 to 0.98.

FIG. 2 shows that the paper sheets wherein cationized arabinogalactan is used are slightly less hydrophobic than when sized with starch based sizing agent. The hydrophobicity is increasing when the degree of substitution is increased, the sample with DS=0.94 providing essentially the same Cobb60 value as the starch reference.

The invention claimed is:

1. A stabilized sizing formulation, comprising a sizing agent and a modified non-food polysaccharide which comprises xylan or arabinogalactan or mixtures thereof and wherein the modified non-food polysaccharide is obtained by modifying a non-food polysaccharide selected from the group consisting of celluloses, hemicelluloses, gums, pectins, xylans, mannans, glucans and mucilages, with a cationically charged amino reagent and wherein the ratio of the modified non-food polysaccharide to the sizing agent is from 0.05 to 1.

2. The formulation according to claim 1, wherein the sizing agent is alkyl ketene dimer (AKD) or alkenyl succinic anhydride (ASA) or a mixture thereof.

3. The formulation according to claim 1, wherein the non-food polysaccharide is xylan or arabinogalactan or mixtures thereof.

4. The formulation according to claim 1, wherein the amino reagent is glycidyltrimethylammoniumchloride.

5. The formulation according to claim 1, wherein degree of substitution of the modified non-food polysaccharide is from 0.03 to 1.5.

6. The formulation according to claim 1, wherein said formulation is in form of a dispersion, preferably an emulsion.

7. A method for preparing the stabilized sizing formulation of claim 1, wherein the sizing agent and the modified non-food polysaccharide are brought into contact within an aqueous solution and a dispersion is formed by homogenization at a pressure from 140 to 160 bar.

8. A method to sizing paper and paper products comprising the steps of obtaining the stabilized sizing formulation according to claim 1, and sizing the paper and paper products.

9. The method according to claim 8, wherein the dosing of the stabilized sizing formulation into pulp is from 0.5 to 3 kg/t.

10. A method for preparation of the modified non-food polysaccharide of claim 1 comprising wherein said method comprises the steps of i. providing a mixture of charging agent, water and a catalytic amount of base, and stirring said mixture thoroughly at a temperature above the room temperature, and ii. introducing said non-food polysaccharide comprising xylan or arabinogalactan or mixtures thereof and a small amount of water to the mixture of step i, and stirring the resulting mixture for several hours at a constant temperature, and subsequently iii. washing and filtering the resulting cationically charged non-food polysaccharide before recovery.

* * * * *